US005878893A

United States Patent [19]

Micienko

[11] Patent Number: 5,878,893

[45] Date of Patent: Mar. 9, 1999

[54] COMBINATION MAGAZINE RACK AND TOILET PAPER DISPENSER

[76] Inventor: Mark Micienko, 921 W. 33rd Pl., Chicago, Ill. 60608

[21] Appl. No.: 891,275

[22] Filed: Jul. 10, 1997

[51] Int. Cl.[6] ..... A47F 5/00

[52] U.S. Cl. ..... 211/13.1; D6/519; 242/598.5; 211/87.01

[58] Field of Search ..... 211/50, 105.1, 211/13.1, 105.6, 119.009, 87.01; D6/519, 523; 242/598.5, 598.3

[56] References Cited

U.S. PATENT DOCUMENTS

| | | | |
|---|---|---|---|
| D. 101,924 | 11/1936 | Smith | D6/519 |
| D. 184,049 | 12/1958 | Gillard | D6/519 |
| D. 214,839 | 8/1969 | Louis | D6/519 |
| D. 227,212 | 6/1973 | Graham | D6/519 |
| D. 358,052 | 5/1995 | Carpenter | D6/519 X |
| D. 364,059 | 11/1995 | Merriweather | D6/519 |
| D. 368,819 | 4/1996 | Lemmons | D6/519 |
| 5,248,105 | 9/1993 | Cooker | 242/598.5 |
| 5,526,943 | 6/1996 | Thompson | 211/87.01 |

*Primary Examiner*—Robert W. Gibson, Jr.

[57] ABSTRACT

A combination magazine rack and toilet paper dispenser is provided including a magazine holder having a rectangular configuration with a front face, a rear face, a bottom face, and a pair of side faces defining an interior space and an open top for releasably receiving a plurality of magazines therein. Further provided is a radio having a housing coupled to the magazine holder for emitting signals received via free space. Also included is a toilet paper dispensing assembly having a pair of elongated retaining members coupled to the bottom face of the housing of the radio and depending downwardly therefrom. A tube is removably coupled between bottom ends of the retaining members for allowing the removable coupling of a roll of toilet paper thereto.

7 Claims, 2 Drawing Sheets

10
12
14
22
24
30
32
34
36
38
40
42
44
46
20
26

12
14
24
38
32
20
20
16

COMBINATION MAGAZINE RACK AND TOILET PAPER DISPENSER

BACKGROUND OF THE INVENTION

1. Field of the Invention

The present invention relates to a combination magazine rack and toilet paper dispenser and more particularly pertains to conveniently storing a plurality of magazines adjacent to a toilet paper dispenser.

2. Description of the Prior Art

The use of toilet paper dispensers is known in the prior art. More specifically, toilet paper dispensers heretofore devised and utilized for the purpose of dispensing toilet tissue are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,248,105 to Cooker; U.S. Pat. Des. 247,077 to Gruber; U.S. Pat. Des. 286,330 to Sussman; U.S. Pat. No. 4,602,759 to Webber; U.S. Pat. Des. 308,612 to Cuevas; and U.S. Pat. Des. 267,607 to Peabody et al.

In this respect, the combination magazine rack and toilet paper dispenser according to the present invention substantially departs from the conventional concepts and designs of the prior art, and in so doing provides an apparatus primarily developed for the purpose of storing a plurality of magazines adjacent to a toilet paper dispenser.

Therefore, it can be appreciated that there exists a continuing need for a new and improved combination magazine rack and toilet paper dispenser which can be used for storing a plurality of magazines adjacent to a toilet paper dispenser. In this regard, the present invention substantially fulfills this need.

SUMMARY OF THE INVENTION

In view of the foregoing disadvantages inherent in the known types of toilet paper dispensers now present in the prior art, the present invention provides an improved combination magazine rack and toilet paper dispenser. As such, the general purpose of the present invention, which will be described subsequently in greater detail, is to provide a new and improved combination magazine rack and toilet paper dispenser which has all the advantages of the prior art and none of the disadvantages.

To attain this, the present invention essentially comprises a magazine holder having a rectangular configuration with a front face, a rear face, a bottom face, and a pair of side faces defining an interior space with an open top. By this structure, the magazine holder is adapted for releasably receiving a plurality of magazines therein. The magazine holder further has a transparent panel formed on the front face thereof for defining a slot. Such panel is designed to allow viewing of an advertisement situated therein. For facilitating the removal of the magazines, the front face of the magazine holder further has a generally rectangular cut out formed therein adjacent a top edge thereof. Further provided is a radio having a housing with a rectangular configuration. As shown in FIG. 1, the housing has a top face, a bottom face, a front face, a rear face, and a pair of side faces defining an interior space. One of the side faces is integrally coupled to a top extent of one of the side faces of the magazine holder. As such, the top face of the housing of the radio is flush with the open top of the magazine holder. The radio further has a frequency window positioned on the front face of the housing to display a current channel into which the radio is presently tuned. Positioned on the front face of the housing on opposite sides of the frequency window is a pair of dials for allowing selective tuning of the radio. A speaker is positioned on the top face of the housing for emitting signals received via free space by the radio. Finally, a toilet paper dispensing assembly is provided. Such dispensing assembly includes a pair of elongated retaining members coupled to the bottom face of the housing of the radio and depending downwardly therefrom. A tube is rotatably and removably coupled between bottom ends of the retaining members for allowing the removable coupling of a roll of toilet paper thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination magazine rack and toilet paper dispenser which has all the advantages of the prior art toilet paper dispensers and none of the disadvantages.

It is another object of the present invention to provide a new and improved combination magazine rack and toilet paper dispenser which may be easily and efficiently manufactured and marketed.

It is a further object of the present invention to provide a new and improved combination magazine rack and toilet paper dispenser which is of a durable and reliable construction.

An even further object of the present invention is to provide a new and improved combination magazine rack and toilet paper dispenser which is susceptible of a low cost of manufacture with regard to both materials and labor, and which accordingly is then susceptible of low prices of sale to the consuming public, thereby making such combination magazine rack and toilet paper dispenser economically available to the buying public.

Still yet another object of the present invention is to provide a new and improved combination magazine rack and toilet paper dispenser which provides in the apparatuses and methods of the prior art some of the advantages thereof, while simultaneously overcoming some of the disadvantages normally associated therewith.

Still another object of the present invention is to store a plurality of magazines adjacent to a toilet paper dispenser.

Lastly, it is an object of the present invention to provide a new and improved combination magazine rack and toilet paper dispenser is provided including a magazine holder having a rectangular configuration with a front face, a rear face, a bottom face, and a pair of side faces defining an interior space and an open top for releasably receiving a plurality of magazines therein. Further provided is a radio having a housing coupled to the magazine holder for emitting signals received via free space. Also included is a toilet paper dispensing assembly having a pair of elongated retaining members coupled to the bottom face of the housing of the radio and depending downwardly therefrom. A tube is removably coupled between bottom ends of the retaining members for allowing the removable coupling of a roll of toilet paper thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
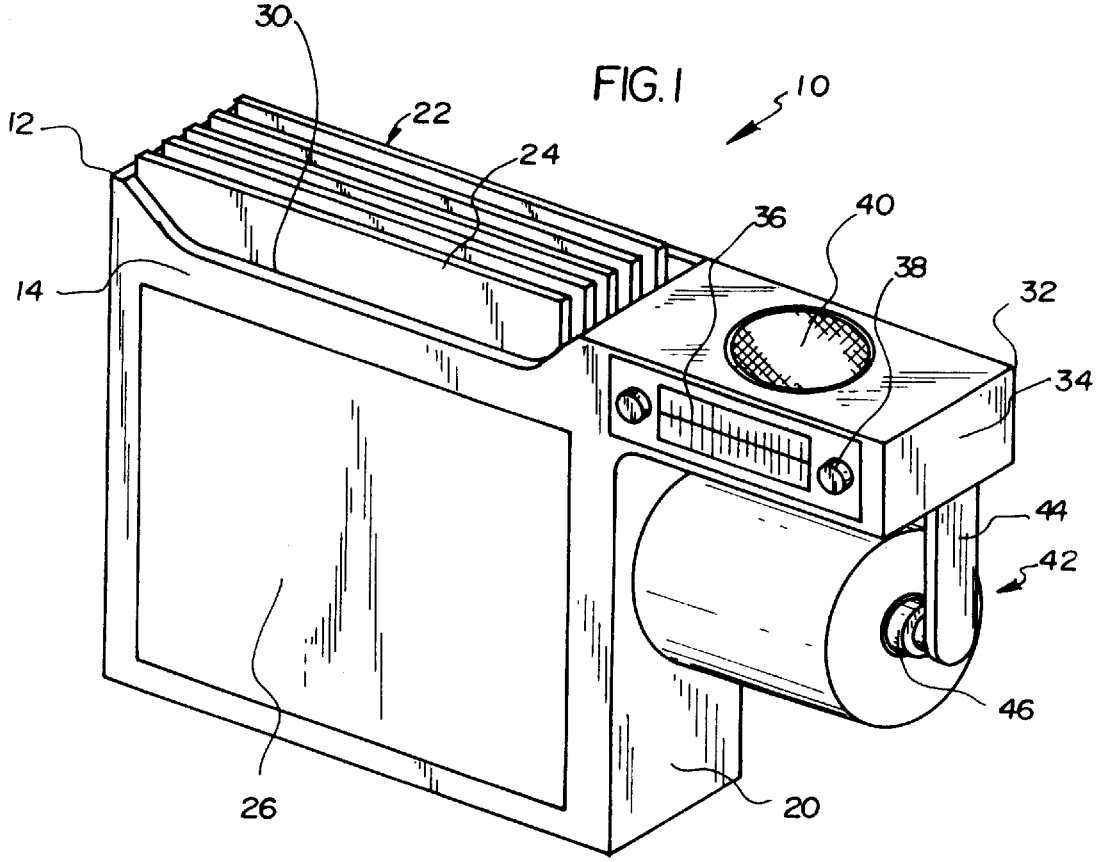
FIG. 1 is a perspective illustration of the preferred embodiment of the combination magazine rack and toilet paper dispenser constructed in accordance with the principles of the present invention.
Figure 2:
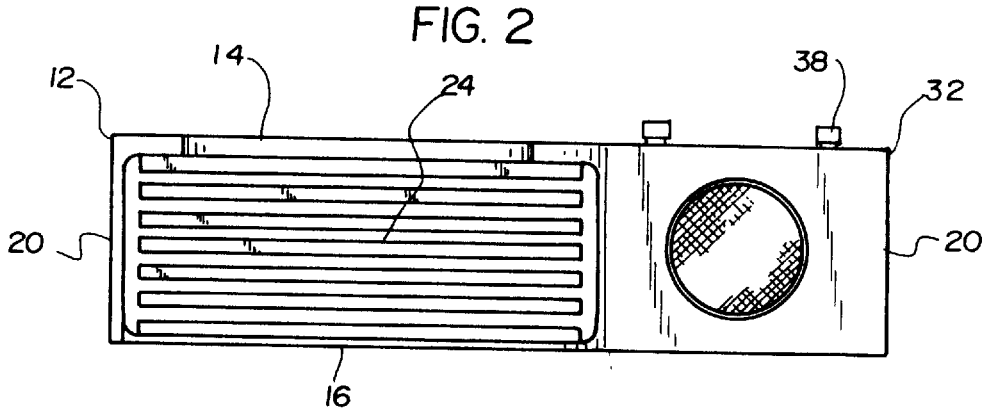
FIG. 2 is a top view of the present invention.
Figure 3:
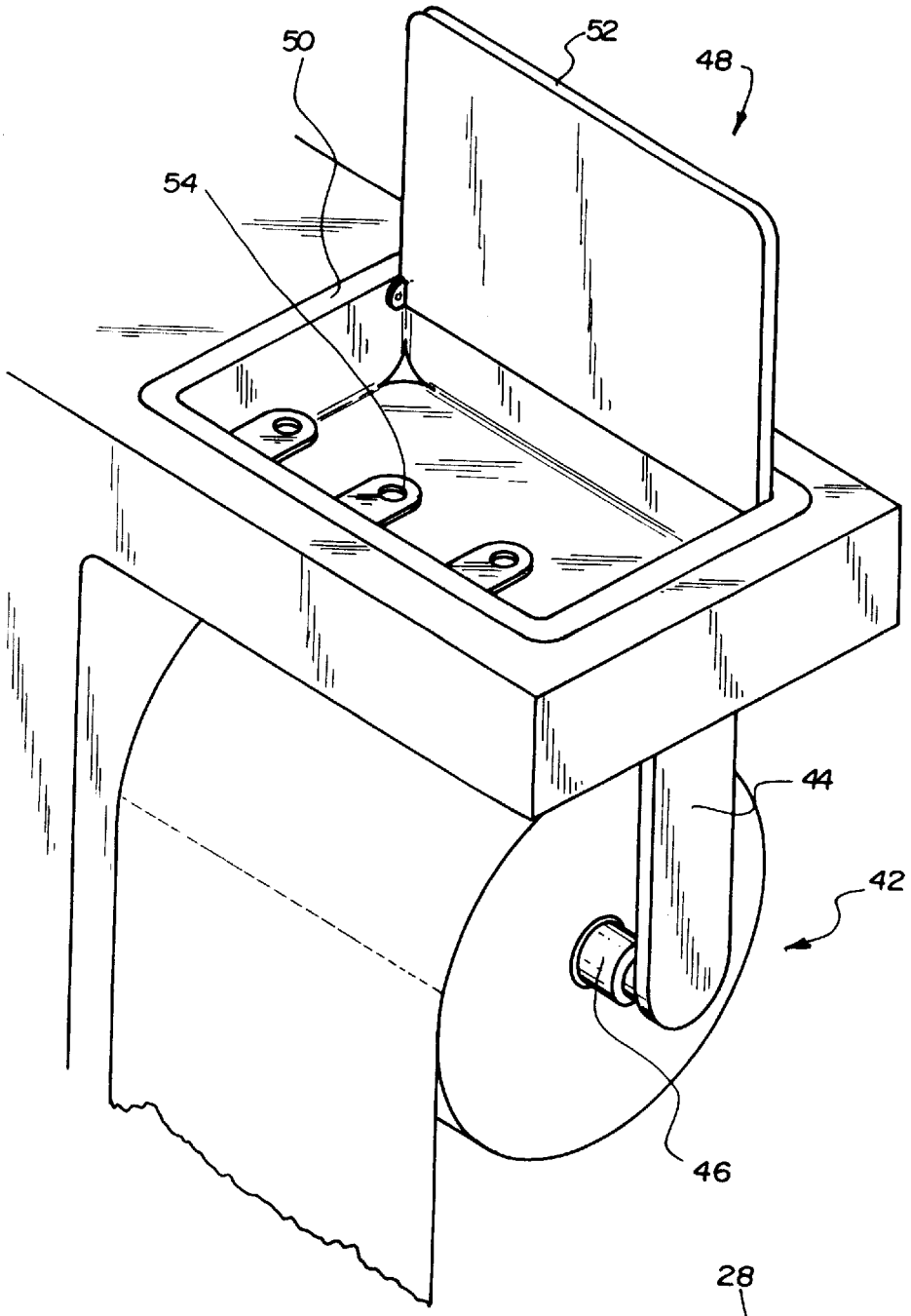
FIG. 3 is a perspective view of an alternate embodiment of the present invention.

With reference now to the drawings, and in particular to FIG. 1 thereof, a new and improved combination magazine rack and toilet paper dispenser embodying the principles and concepts of the present invention and generally designated by the reference numeral 10 will be described.

The present invention, the new and improved combination magazine rack and toilet paper dispenser, is comprised of a plurality of components. Such components in their broadest context include a magazine holder, a radio, and a toilet paper assembly. Such components are individually configured and correlated with respect to each other so as to attain the desired objective.

Figure 4:
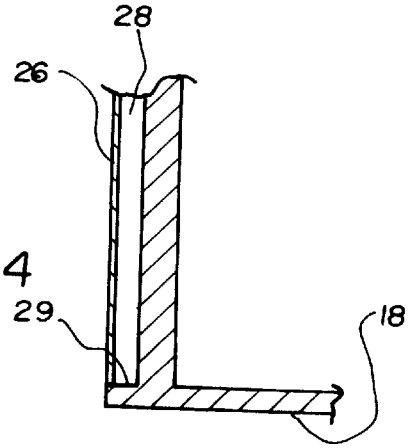
FIG. 4 is a cross-sectional view of the slot and transparent panel of the magazine holder of the present invention.

More specifically, it will be noted that the system 10 of the present invention includes a magazine holder 12 having a rectangular configuration with a front face 14, a rear face 16, a bottom face 18, and a pair of side faces 20 defining an interior space with an open top 22. By this structure, the magazine holder is adapted for releasably receiving a plurality of magazines 24 therein. To accommodate the specific containment of magazines, the front and rear face are square and the bottom and side faces are rectangular thus defining a depth of less than ⅓ the length of the front and rear faces. While not illustrated, the rear face of the magazine holder is equipped with mounting means for allowing the coupling thereof adjacent a toilet. The magazine holder further has a transparent panel 26 formed on the front face thereof for defining a slot 28. Such slot is further defined by a square recess 29 formed in the front face. Note FIG. 4. Such panel is designed to allow viewing of an advertisement situated therein. While not illustrated, the front transparent panel is releasably coupled to the front face of the magazine holder via screws. For facilitating the removal of the magazines, the front face of the magazine holder further has a generally rectangular cut out 30 formed therein adjacent a top edge thereof. As shown in FIG. 1, the rectangular cut out has tapered side edges.

Further provided is a radio 32 having a housing 34 with a rectangular configuration. As shown in FIG. 1, the housing has a top face, a bottom face, a front face, a rear face, and a pair of side faces defining an interior space. One of the side faces of the housing is integrally coupled to a top extent of one of the side faces of the magazine holder. As such, the top face of the housing of the radio is flush with the open top of the magazine holder. The radio further has a frequency window 36 positioned on the front face of the housing to display a current channel into which the radio is presently tuned. Positioned on the front face of the housing on opposite sides of the frequency window is a pair of dials 38 for allowing selective tuning of the radio. A speaker 40 is positioned on the top face of the housing for emitting signals received via free space by the radio. For reasons that will become apparent later, it is important that the housing of the radio has a length equal to that of a standard roll of toilet paper. Further it is imperative that the height of the housing of the radio is less than ⅕ that of the magazine holder.

Finally, a toilet paper dispensing assembly 42 is provided. Such dispensing assembly includes a pair of elongated rectangular retaining members 44 coupled to the bottom face of the housing of the radio and depending downwardly therefrom. A tube 44 is rotatably and removably coupled between bottom ends of the retaining members for allowing the removable coupling of a roll of toilet paper thereto. The retaining members are preferably flexible to allow the removable coupling of the tube. In the alternative, an inboard retainer may be excluded and the tube may be coupled directly to the magazine holder.

In an alternate embodiment, the radio housing is replaced with an ash tray housing 48 having a rectangular configuration including a top face, a bottom face, a front face, a rear face, and a pair of side faces. Situated within the top face of the ash tray housing is a rectilinear tray 50 with an open top which sits flush with the top face. A lid 52 is pivotally mounted to a rear top edge of the tray for pivoting between an open and closed orientation. Finally, three equally spaced horizontal tabs 54 extend inwardly from a front top edge of the tray. Each tab includes an aperture 56 formed therein adjacent an inner edge thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved combination magazine rack and toilet paper dispenser comprising, in combination:

a magazine holder having a rectangular configuration with a front face, a rear face, a bottom face, and a pair of side faces defining an interior space with an open top for releasably receiving a plurality of magazines therein, the magazine holder having a transparent panel formed on the front face thereof for defining a slot adapted to allow viewing of an advertisement situated therein, the front face of the magazine holder further having a generally rectangular cut out formed therein adjacent a top edge thereof for facilitating the removal of the magazines;

a radio having a housing with a rectangular configuration, the housing having a top face, a bottom face, a front face, a rear face, and a pair of side faces defining an interior space, one of the side faces integrally coupled to a top extent of one of the side faces of the magazine holder such that the top face of the housing of the radio is flush with the open top of the magazine holder, the radio further having a frequency window positioned on the front face of the housing to display a current channel into which the radio is presently tuned, a pair of dials positioned on the front face of the housing on opposite sides of the frequency window for allowing selective tuning of the radio, and a speaker positioned on the top face of the housing for emitting signals received via free space by the radio; and a toilet paper dispensing assembly including a pair of elongated retaining members coupled to the bottom face of the housing of the radio and depending downwardly therefrom with a tube rotatably and removably coupled between bottom ends of the retaining members for allowing the removable coupling of a roll of toilet paper thereto.

2. A combination magazine rack and toilet paper dispenser comprising:

a magazine holder having a rectangular configuration with a front face, a rear face, a bottom face, and a pair of side faces defining an interior space with an open top for releasably receiving a plurality of magazines therein;

a radio having a housing coupled to one of the side faces of the magazine holder for emitting signals received via free space; and a toilet paper dispensing assembly including a pair of elongated retaining members coupled to the bottom face of the housing of the radio and depending downwardly therefrom with a tube removably coupled between bottom ends of the retaining members for allowing the removable coupling of a roll of toilet paper thereto.

3. A combination magazine rack and toilet paper dispenser as set forth in claim 2 wherein the radio includes a speaker positioned on a top face of the housing thereof.

4. A combination magazine rack and toilet paper dispenser as set forth in claim 2 wherein a top face of the housing of the radio is positioned flush with the open top of the magazine holder.

5. A combination magazine rack and toilet paper dispenser as set forth in claim 2 wherein the front face of the magazine holder further has a generally rectangular cut out formed therein adjacent a top edge thereof for facilitating the removal of the magazines.

6. A combination magazine rack and toilet paper dispenser as set forth in claim 2 and further including a transparent panel formed on the front face thereof for defining a slot adapted to allow viewing of an advertisement situated therein.

7. A combination magazine rack and toilet paper dispenser comprising:

a magazine holder having a rectangular configuration with a front face, a rear face, a bottom face, and a pair of side faces defining an interior space with an open top for releasably receiving a plurality of magazines therein;

an ash tray having a housing coupled to the magazine holder; and a toilet paper dispensing assembly including a pair of elongated retaining members coupled to the bottom face of the housing of the ash tray and depending downwardly therefrom with a tube removably coupled between bottom ends of the retaining members for allowing the removable coupling of a roll of toilet paper thereto.

* * * * *